US005499691A

United States Patent [19]

Fitzpatrick

[11] Patent Number: 5,499,691

[45] Date of Patent: Mar. 19, 1996

[54] LADDER EMERGENCY BRAKING SYSTEM

[76] Inventor: Peter J. Fitzpatrick, 467 Kearny Ave., Kearny, N.J. 07032

[21] Appl. No.: 344,889

[22] Filed: Nov. 25, 1994

[51] Int. Cl.[6] ..... E06C 5/36

[52] U.S. Cl. ..... 182/107; 248/508

[58] Field of Search ..... 182/107, 129; 135/119; 52/155, 156; 248/500, 508

[56] References Cited

U.S. PATENT DOCUMENTS

| | | | |
|---|---|---|---|
| 2,145,619 | 1/1938 | Brown | 182/107 |
| 3,792,756 | 6/1974 | Kelly | 182/107 |
| 3,870,428 | 3/1975 | Jackson | 248/301 X |
| 4,765,439 | 3/1988 | Kresmery | 182/107 |
| 4,974,699 | 12/1990 | Boring | 182/107 |
| 4,995,476 | 4/1991 | Buck | 182/107 |
| 5,054,579 | 10/1991 | Moson | 182/107 |

FOREIGN PATENT DOCUMENTS

| | | | |
|---|---|---|---|
| 28005 | 6/1917 | Norway | 52/155 |
| 2250312 | 6/1992 | United Kingdom | 182/107 |

*Primary Examiner*—Alvin C. Chin-Shue
*Attorney, Agent, or Firm*—Conrad Clark

[57] ABSTRACT

A slip-on self-locking automatically articulating emergency brakeing system for ladders is described.

Consisting of a metal plate as the complete raw material required for the manufacture of a set of two brakes, one brake designed to fit the left hand side rail, and one brake designed to fit the right hand side rail of said ladder.

A plurality of protrusions diverge from the body (22) of each brake, including a jug handle type lug (20) which most nearly encircles a rung of said ladder, a slide plate (12) which engages the rear portion of said ladder rail.

A slide plate clasp (14) to prevent lateral movement of the device, and structuraly induced incisor column (10) and incisor (8) for use as a perpendicular brakeing mechanism due to right angle reduction.

10 Claims, 5 Drawing Sheets

LADDER EMERGENCY BRAKING SYSTEM

BACKGROUND

FIELD OF THE INVENTION

This invention relates to emergency brakeing systems, more specifically to an improved emergency brakeing system for ladders which are used by workmen such as Painters, Carpenters and roofers and the like.

BACKGROUND

DESCRIPTION OF THE PRIOR ART

The purpose of this invention is to provide a unique device which prevents a ladder from slipping at its base, causing a workman to fall and sustain serious injuries, which can sometimes be debilitating and/or even financialy crippling.

Heretofore, ladder emergency brakeing systems consisted of various types of harness or rubber pads or steel pads or rods attached to the side of the ladder rail and driven into the soft ground.

Scrutiny of these devices and others shown in the Prior Art shows them to be inadequate insofar as the above mentioned pads being flat with no gripping power will slip on soft or wet ground and the above mentioned steel rods or bars will not penetrate hard surfaces such as concrete or blacktop (tarmacadam) or the like which in most cases renders them useless, I.E. if a workman was using a ladder on a roof to get to another roof or a second or third story window and he drove spikes or rods through the lower roof to keep the ladder in place,it would not be appreciated.

My invention however, avoids this scenario while at the same time being ultimately superior to the above mentioned devices. my device while not actualy touching the surface is however poised only a couple of millimeters therefrom and can ONLY be activated by the verticaly down motion of the ladder consequently slight damage 'amounting to two nail holes' is done to the roof but the workman is safe,while the holes can easily be repaired.

BACKGROUND

DESCRIPTION OF PRIOR ART CONT:

Inventors have in the past created numerous types of safety devices for ladders, such as can be seen in U.S. Pat. No. 2,145,619 to Brown 1938, U.S. Pat. No. 3,792,756 to Kelly 1974, U.S. Pat. No. 4,765,439 to Kresmery 1988, U.S. Pat. No. 4,974,699 to Boring 1990 and U.S. Pat. No. 4,995,476 to Buck 1991.

In most cases however the various elements lack novel criterion insofar as they are too expensive to manufacture or they take too long to assemble or the ladder can slip while the device is being applied or its application is too time consuming before and after the job is done or the device has so many parts that its application becomes the largest portion of the work to be done or that the device would become unstable on uneven terrain.

My invention however, incorporates a necessary feature which will articulate any surface plus other features which are not attributable to the Prior Art.

My invention consists of a system having left hand side and right hand side brakes, using no nuts, bolts or accessories of any kind and being configurated from one piece of flat metal plate, they are self locking when positioned on the ladder, and are easily removed with one hand 'which cannot occur by accident' assuring they will be put to constant use while serving a desperate need and saving countless broken bones and lost workdays.

It should be noted here that the above mentioned device can be constructed from a variety of hard plastic materials such as Kevlar and the like, as well as a wide variety of wellknown metals.

Figure 1:
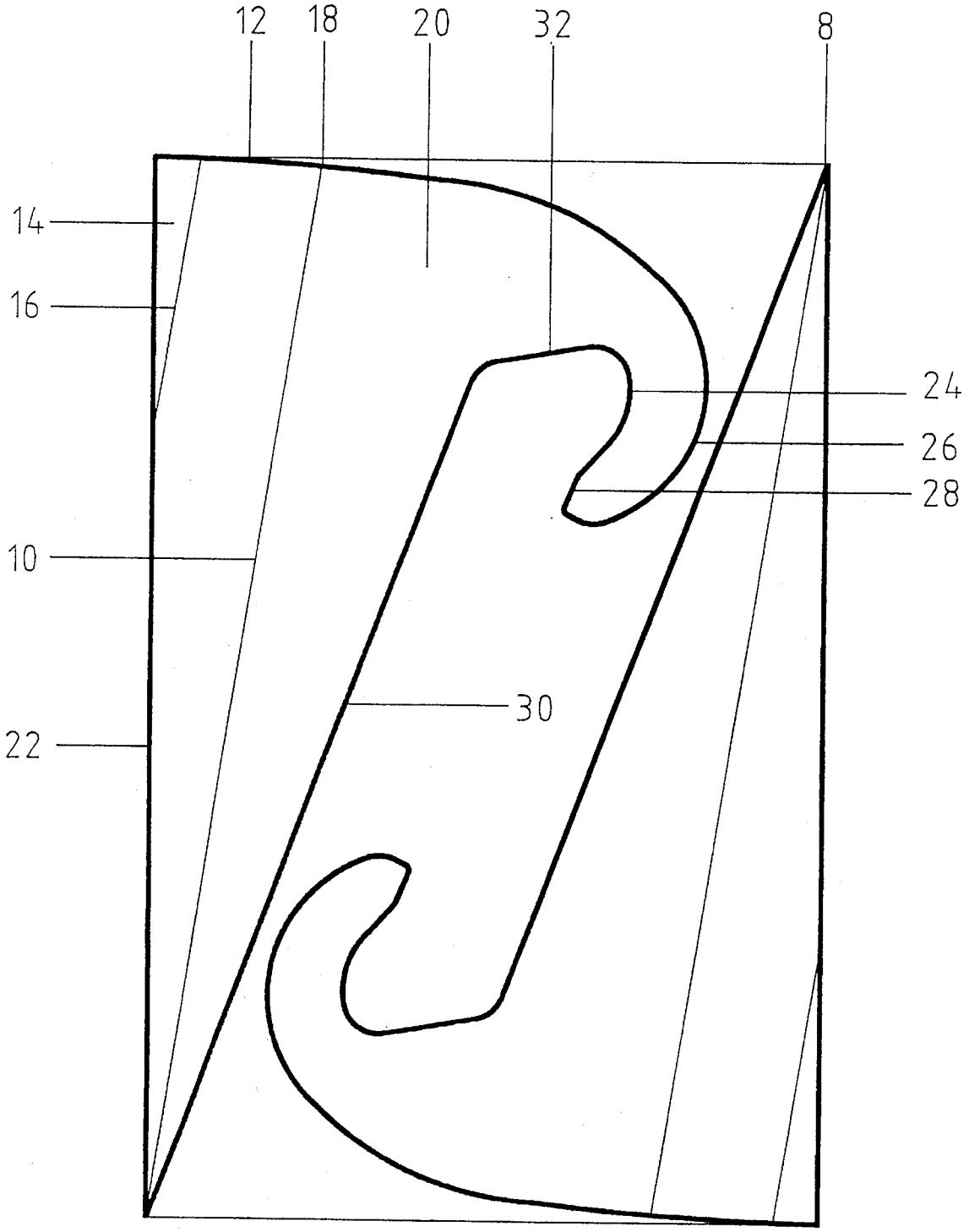
FIG. 1 is a plan view of my invention showing the complete raw material required for production.

| Reference Numerals in Drawings | |
|---|---|
| 8. Incisor | 20. Jug handle type lug |
| 10. Incisor column | 22. Right angle of metal plate |
| 12. Slide plate | 24. Inside parabolic curve |
| 14. Dog ear type clasp | 26. Outside parabolic curve |
| 16. Forty five degree bend | 28. Guide edge |
| 18. Ninety degree bend | 30. Slide edge |
| | 32. Rest edge. |

DETAILED DESCRIPTION OF THE INVENTION

Figure 6:
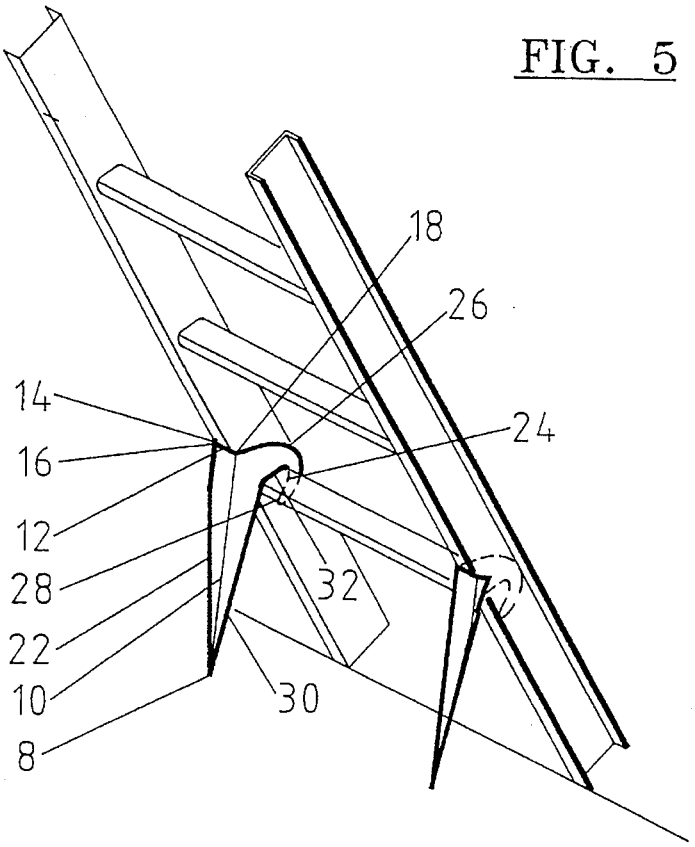
FIG. 6 shows the left hand brake and the right hand brake of the system in place on a rung of a ladder.

With reference to FIGS. 3 through 6, a preferred embodiment of the device in accordance with the Invention comprises a flat metal plate of predetermined dimensions, configurated to and consisting of, a rest edge (32) which rests on a rung of a ladder FIG. 6 said rest edge (32) maintains the device in a seated position on the flat upper surface of said ladders rung while it keeps said device pointing at the ground surface, poised for any emergency, without actualy touching said surface and thereby avoiding the possibility of scarring said surface 'which could be made of very expensive material' while said is moved sideways.

A slide edge (30) which allows said device to slide lateraly as well as back and forth, when being placed on said ladders rung.

A guide edge (28) which guides the jug handle type lug (20) under said rung of said ladder while being positioned on said rung and assures the user of propper attachment to said ladder.

A parabolic curve (26) which, together with an inside curve (24) creates the jug handle type lug (20) said jug handle type lug (20) most nearly encircles said ladder rung in a cradleing fashion and prevents any backward or forward movement, and when placed lateraly against the inside of said ladder rail it operates in conjunction with a dog ear type clasp (14) creating a lateral locking mechanism.

Figure 2:
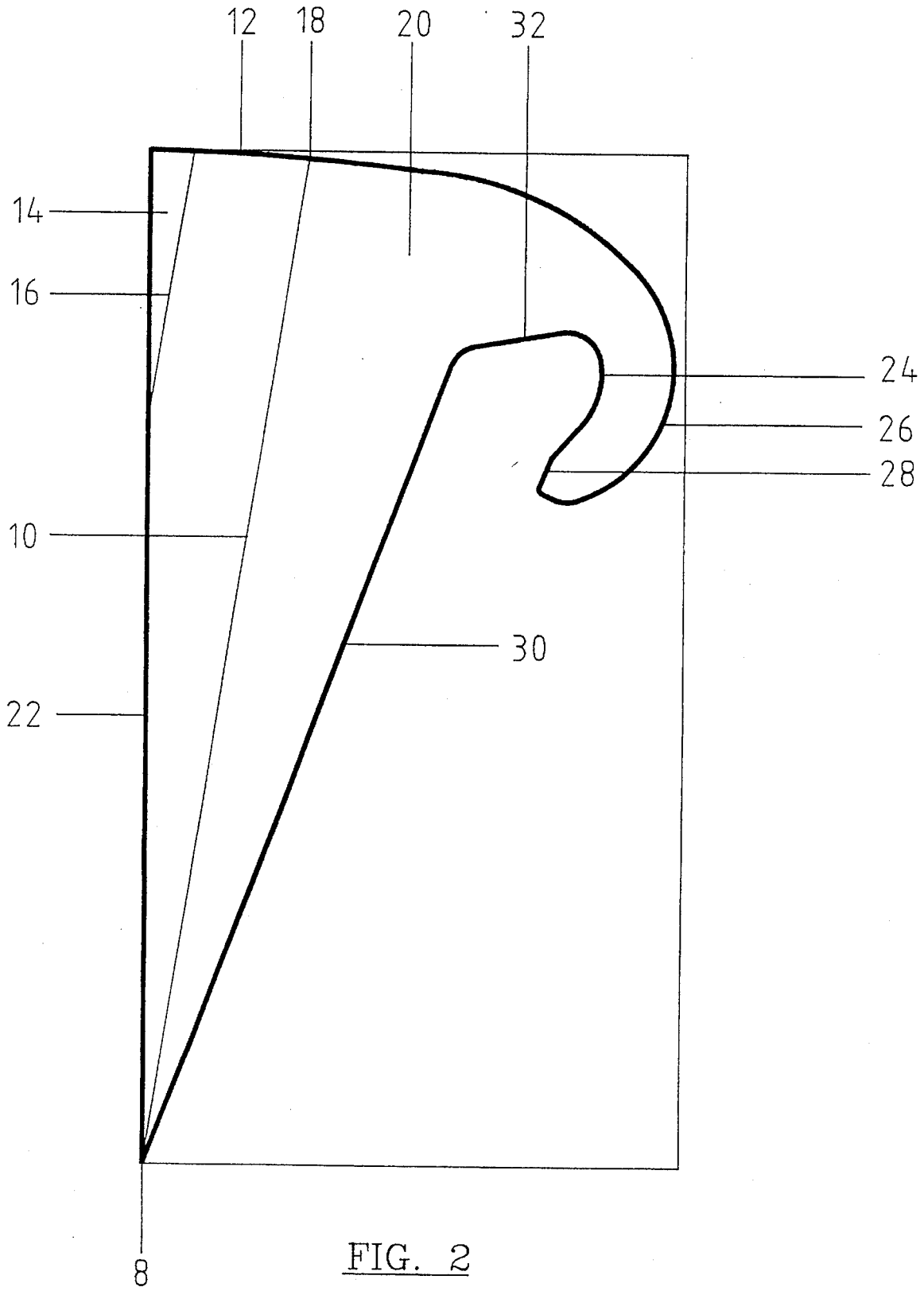
FIG. 2 is a plan view of FIG. 1 showing one section or 'one half' of the emergency brakeing system, with solid lines where the 'cut' is to be made and broken lines where the 'bends' are to be made.
Figure 3:
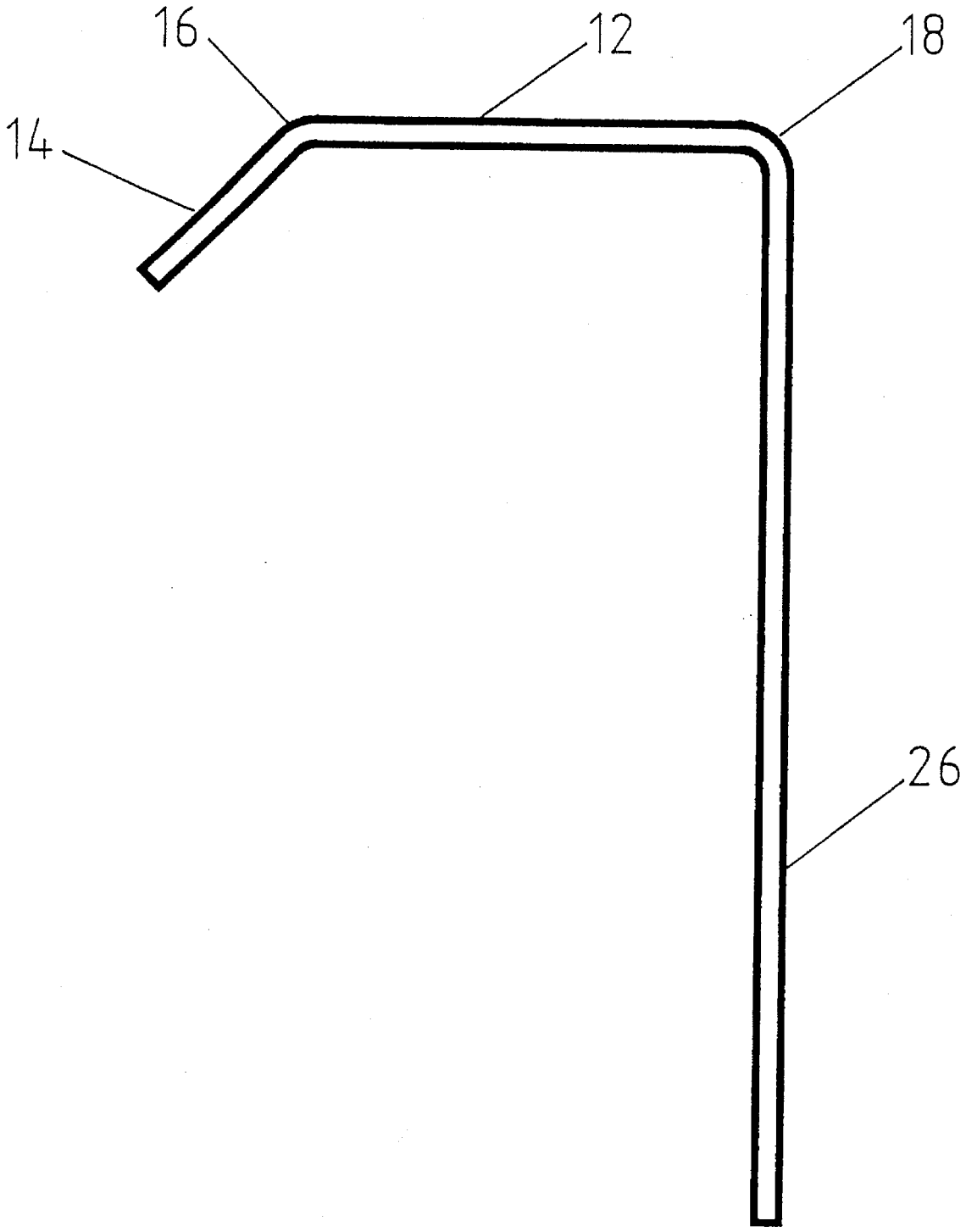
FIG. 3 is an end view of FIG. 4.

A ninety degree bend (18) 'dotted line, FIG. 2' stratigicaly located and running longitudinaly from side 'A' to side 'C' while diverging about 24 degrees from its right angle 'side B' creates maximum strenght and also creates the spinal collumn (10) of the Incisor (8)

A forty five degree bend (16) 'short dotted line FIG. 2' stratigicaly located and running parallel to said ninety degree bend (18) creates said dog ear type clasp (14) which wraps outwardly around the rear portion of said ladder rail and operates in conjunction with said ninety degree bend (18) plus said jug handle type lug (20) to cpmplete said lateral locking mechanism.

A slide plate (12) of the embodiment slides 'verticaly' against the back of said ladder rail for a distance of about two centimeters to lock the device both verticaly and lateraly in position.

The distance between said ninety degree bend and said forty five degree bend should equal that of the width of said ladder rail.

A particularly unique feature of the invention is my theory of Right Angle Reduction to maximise brakeing power.

DETAILED DESCRIPTION OF THE INVENTION

The imaginary profile of a ladder leaning against a structure will suffice to portray a right angle triangle, said structure being said right angle and said ladder being the hypotenuse it becomes apparent that if said ladder were to slip at its base, then the distance between the apex of said ladder and the surface on which it stands will decrease, causing right angle reduction. I.E. the hypotenuse of the triangle stays constant while the base and height vary. This right angle reduction, together with the downward vertical force which causes the slippage, will force the incisors (8) to pierce the surface 'on which said ladder stands' forestalling any slippage and the more force that is exerted on said ladder to slip the more said incisors will penetrate said surface and prevent a potential disaster.

In the above scenario, when said ladder has been moved to its next position the two small holes made by said incisors (8) can easily be repaired with silicone caulking or the like.

I have developed other devices for this purpose but found them wanting as are the devices in the Prior Art. Devices such as would articulate with the hollow rung of aluminum ladders or that would attach to two rungs at the same time or to both rails and rungs together or individualy or any combination of the above, but they require multiple parts or attachments or accessories creating unnecessary expense and labor and nullifying their potential.

DETAILED DESCRIPTION OF THE INVENTION

FIG. 1 illustrates the complete raw material required for production of the Invention, showing one piece of flat metal plate to be cut into two parts following the solid lines.

For purposes of clarity, side B of the drawing will be the Right Angle of said metal plate and side A will be 'closest to' and side C 'farthest away' from the reader.

There is little need for further mention of sides A, B, or C in the specifications, since after cutting the plate to make the two parts of the system these sides will become irrelevant.

Having prepared a piece of flat metal plate with approximate dimensions of 18 mm×28 mm×3 mm (7"×11"×⅛) see FIG. 1 a continueous cut is made, starting on side A of FIG. 1 about 5 mm (3/16") from its intersection with side B, the cut travels toward side C and at the same time diverges from side B about 24 degrees, to a point about 5 cm (2") before intersecting with side C, creating the slide edge (30), the cut then turns clockwise about 55 degrees and travels straight for a distance of about 4 cm (1½") creating the rest edge (32), the rest edge (32) engages the upper outer flat surface of an aluminum ladder rung and together with the jug handle type lug (20) becomes a locking mechanism.

The cut again turns clockwise about 90 degrees and continues in an arc of about 4 cm (1½") for a distance of about 5 cm (2") creating the inside curve (24), the cut then makes an anticlockwise turn of about 50 degrees and continues straight for a distance of about 2 cm (¾") creating the guide edge (28) which should run parallel to the slide edge (30), the cut then makes still another anticlockwise turn of about 90 degrees and continues 'while diverging from the previous curve (24)' in a parabolic curve (26) until it intersects with and becomes part of side C.

The reader will see at this point that one half of the metal plate of FIG. 1 has been utilized, and that the same operation on the remainder of the plate 'but in reverse order' will produce the second half of the brakeing system.

Figure 4:
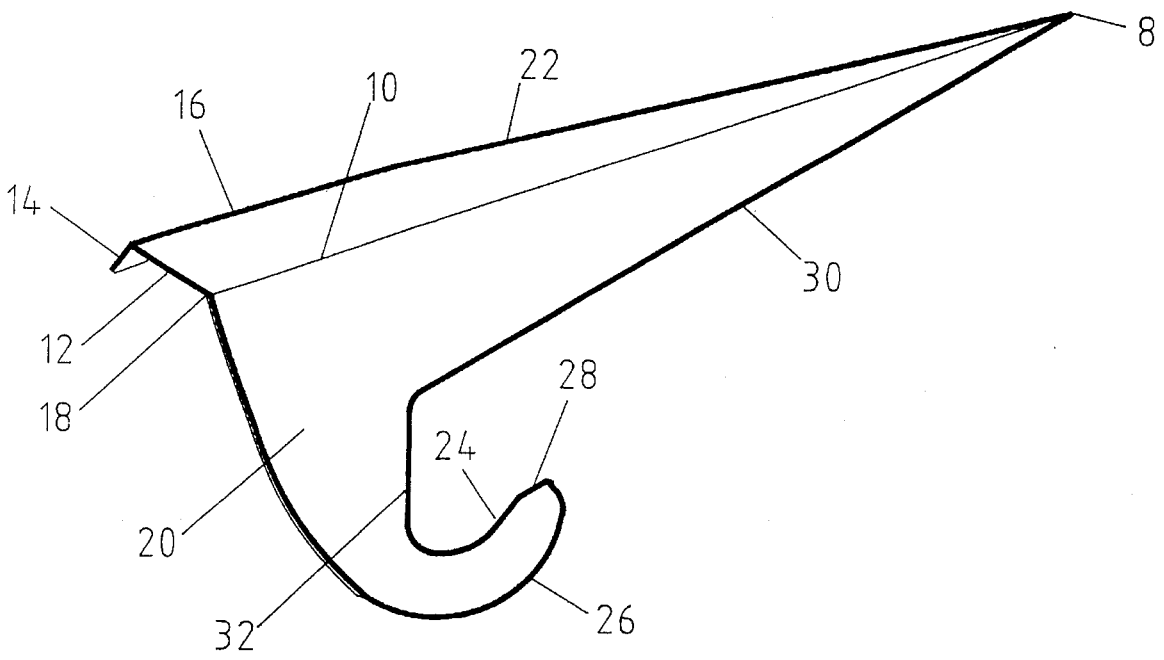
FIG. 4 is an isometric view of FIGS. 2 and 3 wherein the forty five and ninety degree bends have been applied.
Figure 5:
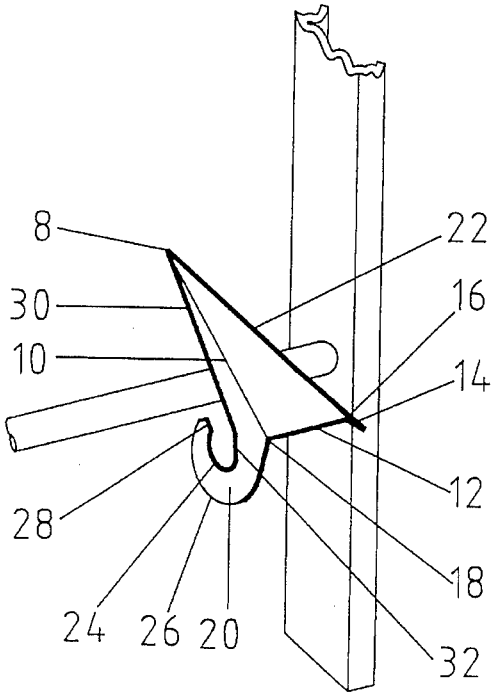
FIG. 5 is an isometric view of the invention being placed on a rung of a ladder.

The placeing of a ninety degree bend and a forty five degree bend FIG. 4 on each cut-out on respective sides will give the maker a finished product that is ready for use.

Since placement of a ninety degree bend and a forty five degree bend must be made on 'the same side of the cut-out to produce the left hand brake, the same operation on the opposite side produces the right hand side brake, the complete operation can be carried out using a press means, known to those of skill in the Prior Art.

OBJECTS AND ADVANTAGES

Accordingly, besides the obvious disadvantages described in the Prior Art, several objects and advantages of my Invention are.

(a) Its total composition consists of one piece of metal plate approximatly 18 mm×28 mm×3 mm (7"×11"×⅛") as the complete raw material required for its manufacture and it requires no accessories of any kind.

(b) It is light weight, weighing only ounces, making it very portable and available for constant use.

(c) It is very strong and because of its design very ridgid, superbly designed for the rigours of the job site.

(d) It is compact, small enough to fit in a workmans coat pocket, allowing it to always be where it is needed.

(e) It is cheap and easy to manufacture, makeing it afordable and desirable for everyone for constant use.

(f) It fills a need that desperately needs filling.

(g) It is self locking when snapped into place with just one hand and remains there to forestall any emergency.

(h) It is easily removed with just a twist when the locking mechanism is released with the push of a finger.

(i) It is automatic, it is activated only when the ladder to which it is attached slips and right angle reduction occurs.

(j) It will stop all slipping movement on any surface, including concrete, blacktop 'tarmacadam' floor tile, ice, etc, etc.

Still further objects and advantages will become apparent from a consideration of the ensuing description and drawings.

Conclusion Ramifications and Scope of the Invention

Thus the reader will see that the Ladder Emergency Brakeing System of my Invention provides a highly reliable, lightweight, yet economical device which can be used by persons of almost any age.

While my above description contains many specificities, these should not be construed as limitations on the scope of this Invention, but rather as an exemplification of one preferred embodiment thereof, many other variations are possible.

For example:

A preferred embodiment could be made to fit into the hollow interior of the rung of an aluminum ladder, or an embodiment could be made to lock onto two seperate rungs of the same ladder at the same time, but for various reasons including expence, I do not find them important enough to show as ramifications in the drawings.

Accordingly, the scope of the Invention should be determined not by the embodiment illustrated, but by the appended claims and their legal equivalents.

I claim:

1. A ladder braking device comprising:

braking means for pressing against or piercing a surface on which a base of a ladder rests;

rung engagement means for securing said braking means onto a rung of said ladder while allowing said braking means to rotate about said rung; and locking means for fixing the rotation of said braking means against rotation by pushing against the rail when said braking means contacts said surface.

2. A braking device as claimed in claim 1, in which said rung engagement means comprises a lug adapted to fit snugly over the top of said rung.

3. A braking device as claimed in claim 2, in which said lug comprises seating means for holding said braking means apart from said rail and adjacent said surface when said ladder is positioned upwardly leaning against a structure.

4. A ladder braking device as claimed in claim 1, in which said locking means comprises securing means capable of holding said engaging means adjacent to the rail.

5. A ladder braking device as claimed in claim 4, in which said securing means is a clasp adapted to fit outwardly around said rail.

6. A braking device as claimed in claim 1, in which said braking means is tapered to form a point.

7. A braking device as claimed in claim 1, in which said device is configured from a single sheet of material.

8. A braking device as claimed in claim 7, wherein said material is metal or kevlar.

9. A ladder braking system comprising:

a plurality of ladder braking devices comprising;

a first device comprising;

braking means for pressing against or piercing a surface on which a base of a ladder rests;

rung engagement means for securing said braking means onto a rung of a said ladder while allowing said braking means to rotate about said rung; and locking means for fixing the rotation of said braking means against rotation by pushing against the left rail of said ladder when said braking means contacts said surface; and a second device comprising;

braking means for pressing against or piercing a surface on which a base of a ladder rests;

rung engagement means for securing said braking means onto a rung of a said ladder while allowing said braking means to rotate about said rung; and locking means for fixing the rotation of said braking means against rotation by pushing against the right rail of said ladder when said braking means contacts said surface.

10. A braking system as claimed in claim 9, in which said first and second devices are each formed from a single sheet of material.

* * * * *